US008746192B2

(12) United States Patent
Kawamura

(10) Patent No.: US 8,746,192 B2
(45) Date of Patent: Jun. 10, 2014

(54) TWO-STROKE INTERNAL COMBUSTION ENGINE AND ITS SCAVENGING METHOD

(75) Inventor: Kunimune Kawamura, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 473 days.

(21) Appl. No.: 13/010,860

(22) Filed: Jan. 21, 2011

(65) Prior Publication Data

US 2011/0180054 A1 Jul. 28, 2011

(30) Foreign Application Priority Data

Jan. 22, 2010 (JP) ..... 2010-012551

(51) Int. Cl.
*F02B 25/00* (2006.01)

(52) U.S. Cl.
USPC ..... 123/73 A; 123/73 AA; 123/73 FA; 123/65 A; 123/65 P

(58) Field of Classification Search
USPC ..... 123/73 AA, 73 A, 73 FA, 65 A, 65 P
See application file for complete search history.

(56) References Cited

U.S. PATENT DOCUMENTS

| | | | | |
|---|---|---|---|---|
| 6,257,179 | B1 | 7/2001 | Uenoyama et al. | |
| 6,289,856 | B1 | 9/2001 | Noguchi | |
| 6,640,755 | B2 * | 11/2003 | Araki | 123/73 PP |
| 6,962,132 | B2 * | 11/2005 | Hoche et al. | 123/73 A |
| 7,017,537 | B2 * | 3/2006 | Osburg et al. | 123/73 A |
| 7,093,570 | B2 * | 8/2006 | Mavinahally et al. | 123/73 D |
| 7,146,942 | B2 * | 12/2006 | Yuasa et al. | 123/73 PP |
| 7,658,170 | B2 | 2/2010 | Wada et al. | |
| 2002/0112681 | A1 * | 8/2002 | Rosskamp et al. | 123/73 R |
| 2002/0117130 | A1 | 8/2002 | Toda | |
| 2006/0185632 | A1 * | 8/2006 | Mavinahally | 123/73 V |
| 2007/0057386 | A1 | 3/2007 | Koizumi | |

FOREIGN PATENT DOCUMENTS

| | | | |
|---|---|---|---|
| EP | 1134380 | A2 | 9/2001 |
| EP | 1705350 | A2 | 9/2006 |
| JP | 2001-355450 | | 12/2001 |
| WO | 02061245 | A1 | 8/2002 |

OTHER PUBLICATIONS

Extended European Search Report issued in corresponding European Patent Application No. 11151661.3 dated Jul. 20, 2012 (5 pages).

* cited by examiner

*Primary Examiner* — Marguerite McMahon
*Assistant Examiner* — James Kim
(74) *Attorney, Agent, or Firm* — Kilyk & Bowersox, P.L.L.C.

(57) ABSTRACT

In a two-stroke internal combustion engine using air for scavenging its combustion chamber (4), a scavenging passage (6) communicating with a crankcase (2) and a combustion chamber (4) is charged first with rich air-fuel mixture generated by a carburetor, next with lean air-fuel mixture, and next with air through an in-piston passage (36). The lean air-fuel mixture is generated in the in-piston passage 36 by diluting the air-fuel mixture with the air. In each scavenging stroke to scavenge the combustion chamber (4), the combustion chamber (4) is supplied first with the air (40) and next with the lean air-fuel mixture (42) from the scavenging passage (6). The use of the lean-air-fuel mixture (42) next to the air (40) contributes to reduce acceleration failure or engine stop caused by sudden acceleration.

5 Claims, 7 Drawing Sheets

TWO-STROKE INTERNAL COMBUSTION ENGINE AND ITS SCAVENGING METHOD

CROSS-REFERENCE TO RELATED APPLICATIONS

The present application claims priority from Japanese Patent Application No. 2010-12551, filed Jan. 22, 2010, which is incorporated herein by reference.

FIELD OF THE INVENTION

The present invention relates to a two-stroke internal combustion engine configured to use air-fuel mixture compressed in its crankcase for scavenging the crankcase. The invention also relates to a scavenging method for the engine.

BACKGROUND OF THE INVENTION

Two-stroke internal combustion engines are widely used in work apparatuses such as chain saws and brush cutters. This kind of portable power tools or work apparatuses, in general, have mounted an engine of a crankcase compression type that introduces air-fuel mixture into the crankcase and compresses it therein with a piston.

As already known, two-stroke internal combustion engines use air-fuel mixture to scavenge their combustion chambers. It is ideal that scavenging can be completed without any outflow of air-fuel mixture from the engine. Actually, however, there is the problem of "blow-by", which is the phenomenon that air-fuel mixture partly flows out of the engine.

To cope with this blow-by problem, Japanese Patent Laid-open Publication JP 2001-355450 A (hereinafter referred to as Patent Document 1) proposes to introduce fuel-lean air-fuel mixture (hereinafter referred to as "lean air-fuel mixture" or "lean mixture" as well) into the combustion chamber at a final stage of the combustion stroke and next introduce fuel-rich air-fuel mixture (hereinafter referred to as "rich air-fuel mixture" or "rich mixture" as well) into the combustion chamber. More specifically, the engine has two mixture ports (a first mixture port and a second mixture port) opening into the cylinder bore, and these first and second mixture ports are opened and closed by the piston. The lean air-fuel mixture is introduced into the crankcase from the first mixture port and supplied to the combustion chamber through a scavenging passage that communicates with both the crankcase and the combustion chamber. On the other hand, the rich air-fuel mixture is introduced into the combustion chamber from the second mixture port.

Thus, this method scavenges the combustion chamber with lean mixture introduced there at the final stage of the combustion stroke. Therefore, air-fuel mixture exiting the engine is fuel-lean mixture containing less fuel, and the amount of fuel outflow can be reduced.

Besides the aforementioned scavenging that uses lean air-fuel mixture, further scavenging methods using air are known (Japanese Patent Laid-open Publications JP 2001-012249 A and JP 2001-239463 A, hereinafter referred to as Patent Document 2 and Patent Document 3, respectively). Patent document 2 discloses air-headed stratified scavenging. The air-headed stratified scavenging supplies air beforehand into a scavenging passage in communication with the combustion chamber and the crankcase. In each subsequent scavenging stroke, the air in the scavenging passage is first introduced into the combustion chamber. Thereafter, air-fuel mixture is introduced from the crankcase into the combustion chamber through the scavenging passage. Patent Document 3 discloses air-headed stratified scavenging as well.

More specifically, Patent Document 3 relates to a two-stroke internal combustion engine using a carburetor that has an air passage for air to pass through and a mixture passage for generating air-fuel mixture. The air passage and the mixture passage of the carburetor communicate with an air port and a mixture port, respectively, which both open into the cylinder bore. The air port and the mixture port are opened and closed by a piston, and air-fuel mixture is supplied to the crankcase through the mixture port. The piston has formed a groove in its cylindrical outer surface, which can communicate with the air port and is bifurcated into right and left branches along the outer circumference of the piston. Through this groove, the air port communicates with right and left scavenging passages, and the scavenging passages are charged with air. In a first portion of each scavenging stroke, the air in the scavenging passages is introduced into the combustion chamber. In a second portion of each scavenging stroke, the air-fuel mixture in the crankcase is introduced into the combustion chamber through the scavenging passages.

The scavenging methods as disclosed in Patent Document 2 and Patent Document 3 utilize the heading or leading air, but these methods have difficulties in deciding appropriate timing to start scavenging with the heading air and in regulating the amount of the heading air.

Patent document 2 suggests using a crankshaft web to open and close the inlet (an aperture facing to the crankcase) of the scavenging passage, thereby controlling a blowout timing for scavenging.

Furthermore, these scavenging methods using heading air are liable to suffer large changes in air-fuel ratio in the combustion chamber upon sudden acceleration, which often results in acceleration failure or engine stop. Taking it into consideration and to cope with sudden acceleration from idling, Patent Document 3 proposes to use a supplemental passage in an air valve provided in the air passage of the carburetor to ensure introduction of leading air into the combustion chamber even in the idling state.

The technique described in Patent Document 3 assumes that rich air-fuel mixture is needed for idling operation and lean air-fuel mixture with a relatively lean fuel ratio is used for normal operation. Under this assumption, this Patent Document 3 presumes that some of the leading air introduced into the combustion chamber will inevitably remain there even after scavenging, and proposes to introduce into the crankcase a richer air-fuel mixture during idling operation, which is richer in fuel ratio as much as compensating the shortage of fuel component in the remaining amount of the leading air. Therefore, when the engine is suddenly accelerated, since the richer air-fuel mixture introduced during idling operation partly remains in the crankcase, an air-fuel mixture containing the remaining part of the richer air-fuel mixture is introduced into the combustion chamber to ensure reliable acceleration of the engine.

Patent Document 2 and Patent Document 3 have the common idea of charging scavenging passages with heading air and using it for scavenging. In the process of charging the scavenging passages with the heading air, the leading portion of the air entering into the scavenging passages hits the air-fuel mixture having remained in the scavenging passages, and makes a portion of air containing fuel at its leading end. Therefore, even though "10" parts of the heading air, for example, are charged in each scavenging passage, its leading "2" parts, for example, inevitably contain fuel. As a result, in theory, even when ten parts of heading air are charged for scavenging, its two parts contain fuel component. This means that the fuel component contained in the two parts of the heading air is undesirably emitted by scavenging.

SUMMARY OF THE INVENTION

It is therefore an object of the present invention to provide a two-stroke internal combustion engine and a scavenging method thereof that employ a scavenging system using air for scavenging and capable of reducing acceleration failure or engine stop caused by sudden acceleration.

A further object of the present invention is to provide a two-stroke internal combustion engine and a scavenging method thereof capable of substantially increasing the amount of air usable as heading air for scavenging that uses heading air charged in scavenging passages.

According to the first aspect of the present invention, there is provided a scavenging method for use with a two-stroke internal combustion engine; comprising:

introducing air into a combustion chamber in a first portion of a scavenging stroke;

introducing lean air-fuel mixture in an amount regulated at least by a crank angle in a second portion of the scavenging stroke, which is subsequent to said first portion; and introducing rich air-fuel mixture of a predetermined air-fuel ratio in a third portion of the scavenging stroke, which is subsequent to said second portion.

The term "rich air-fuel mixture" is used in this specification only for distinguishing it from "lean air-fuel mixture". Thus, the "rich" air-fuel mixture is normal air-fuel mixture of a predetermined air-fuel ratio just generated by a carburetor and delivered to the mixture passage. According to the first aspect of the present invention, the combustion chamber is scavenged by heading air as some conventional methods did. Even if blow-by of air-fuel mixture occurs, the amount of fuel component outflow due to the blow-by can be reduced because it is the lean air-fuel mixture that enters next to the air when they are introduced into the combustion chamber. The lean air-fuel mixture contains only a small amount of fuel. Therefore, it is not only possible to reduce blow-by of air-fuel mixture by scavenging primarily using the air, but also possible to minimize acceleration failure or engine stop upon sudden acceleration, which are problems involved in conventional air-headed scavenging, by introducing the lean air-fuel mixture next to the air into the combustion chamber.

According to the second aspect of the present invention, there is provided a scavenging method for use with a two-stroke internal combustion engine, comprising:

providing a scavenging passage in communication with a crankcase and a combustion chamber; and charging the scavenging passage, from an exit end thereof, first with rich air-fuel mixture of a predetermined air-fuel ratio, next with lean air-fuel mixture in an amount regulated at least by a crank angle, and next with air;

wherein, in each scavenging stroke, the combustion chamber is supplied, from the exit end of the scavenging passage, first with said air, next with said lean air-fuel mixture, and next with said rich air-fuel mixture.

According to the second aspect of the present invention, it is possible to minimize acceleration failure or engine stop caused by sudden acceleration while reducing blow-by of air-fuel mixture here again like the first aspect of the invention. In parallel, according too the second aspect of the invention, it is possible to prevent the air from directly hitting a residual of the rich air-fuel mixture in the crankcase or in the scavenging passage. This is because the lean air-fuel mixture in an amount regulated at least by a crank angle is charged in the scavenging passage before the air is charged. As to the lean air-fuel mixture, the amount regulated by the crank angle means an amount intended by the engine design. As a result, the lean air-fuel mixture exists as a buffer between the air and the rich air-fuel mixture when the air is charged in the scavenging passage. Thus, this scavenging method prevents that a considerable amount of air charged in the scavenging passage mixes with rich air-fuel mixture and thereby changes to a lean air-fuel mixture, and therefore ensures that almost all of the substantially increased amount of air acts to scavenge the combustion chamber.

Furthermore, according to the second aspect of the invention, since the lean air-fuel mixture is charged in the scavenging passage before the air is charged therein, it is possible to prevent the air from entering the crankcase through the scavenging passage. Consequently, the air-fuel mixture in the crankcase can be prevented to fluctuate in air-fuel ratio due to undesirable intrusion of the air for scavenging into the crankcase. This mechanism is explained below in greater detail. When the piston starts its upstroke, negative pressure in the crankcase increases, and this may cause the air charged in the scavenging passage to enter the crankcase. According to the present invention, however, the lean air-fuel mixture is charged in the scavenging passage with before the air is supplied therein. Therefore, even though some gas inevitably intrudes into the crankcase from the scavenging passage, the gas that may intrude is the lean air-fuel mixture instead of air. Thus, the use of the lean air-fuel mixture as a buffer between the rich air-fuel mixture and the air also contributes to reducing fluctuations of the air-fuel ratio of the air-fuel mixture in the crankcase and hence contributes to stabilizing the engine operation.

The "predetermined air-fuel rat" herein pertains to an air-fuel ratio of air-fuel mixture just generated by the carburetor, which is provided in the intake system of the engine. This air-fuel mixture is called herein the "rich air-fuel mixture" as already explained. The rich air-fuel mixture, air and lean air-fuel mixture are preferably charged in the scavenging passage through a groove formed along a circumferential outer wall of the piston (hereinafter called "piston wall groove" as well) or through a passage formed inside the piston (hereinafter called "in-piston passage" as well). These piston wall groove and in-piston passage are collectively referred to as "piston gas passage" in this specification. In case the engine is configured to charge air-fuel mixture in the scavenging passage through the in-piston passage formed inside the piston, the piston can be cooled by the fuel component in the air-fuel mixture flowing in the in-piston passage.

With regard to sequential charging of rich mixture, lean mixture and air in the scavenging passage, the timing for introducing rich mixture as generated by the carburetor into the crankcase should preferably follow after the timing for charging rich mixture into the scavenging passage. By anticipating the charging of rich mixture into the scavenging passage through the piston wall groove and/or in-piston passage, rich mixture, lean mixture and air can be reliably charged in the scavenging passage through the piston wall groove and/or in-piston passage.

According to the third aspect of the present invention, there is provided a two-stroke internal combustion engine having a cylinder bore in which a piston is fitted to define a combustion chamber in the cylinder bore, and a scavenging passage opening into the cylinder bore to communicate with the combustion chamber and a crankcase, said scavenging passage being opened and closed by strokes of the piston, so as to introduce air-fuel mixture generated by a carburetor into the crankcase and to supply the air-fuel mixture from the crankcase to the combustion chamber through the scavenging passage while compressing the air-fuel mixture with the piston, comprising:

a lean mixture supply means for supplying the scavenging passage with lean air-fuel mixture in a first predetermined crank angle range, said lean air-fuel mixture being prepared by diluting said air-fuel mixture generated by the carburetor with air; and an air supply means for supplying the scavenging passage with air in a second predetermined crank angle range, wherein the air and the lean air-fuel mixture are stored in stack in the scavenging passage in this order from an opening thereof to the combustion chamber toward the crankcase, and the air and the lean air-fuel mixture are introduced into the combustion chamber in this order from the scavenging passage to scavenge the combustion chamber.

In a preferred embodiment of the present invention, the piston gas passage partly constitutes the lean mixture supply means and the air supply means. The piston gas passage may be a groove formed on a circumferential surface of the piston, or an in-piston passage formed inside the piston.

DETAILED DESCRIPTION OF THE INVENTION

A preferred embodiment of the present invention is explained below with reference to the accompanying drawings.

Figure 1:
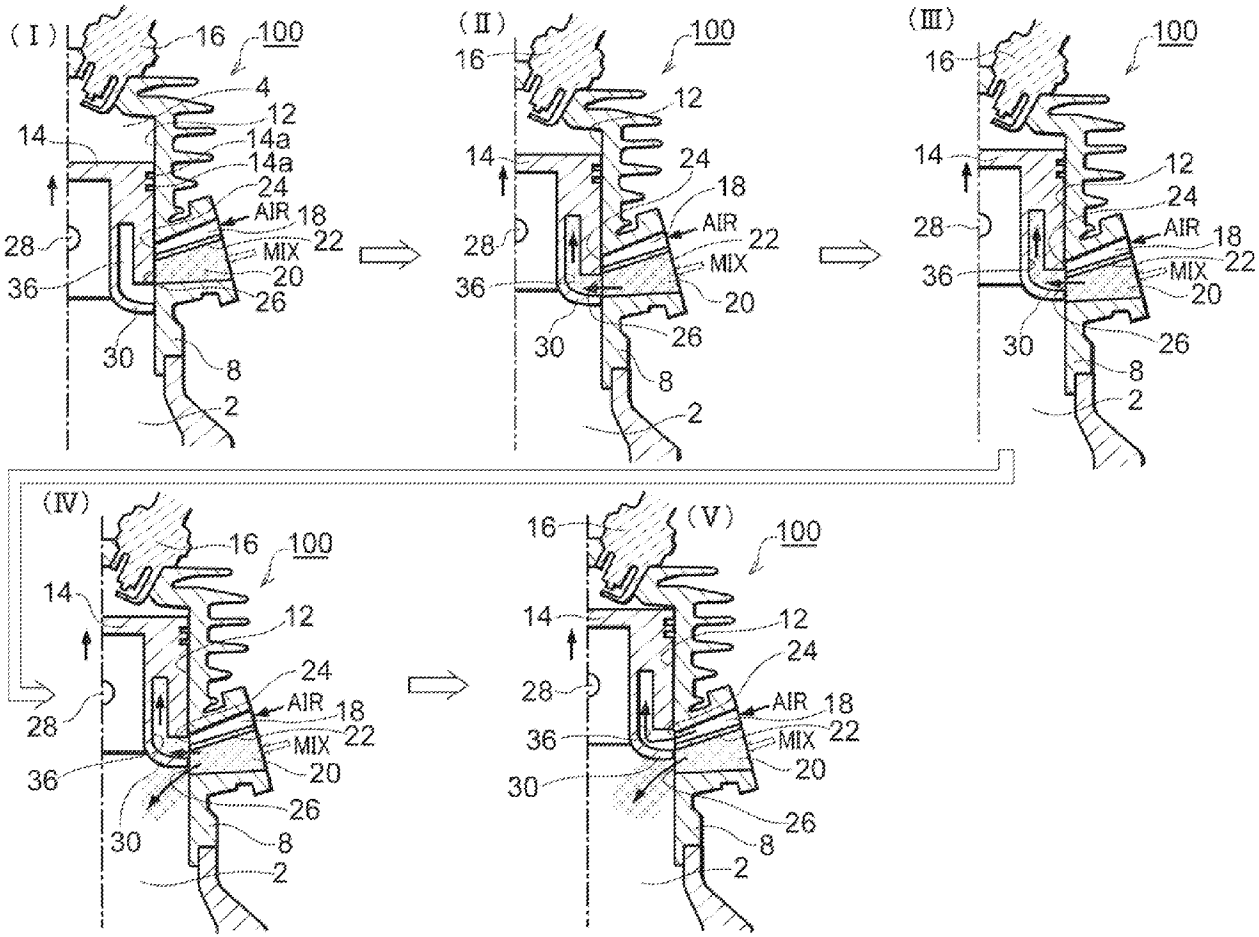
FIG. 1 illustrates transitional phases of the engine, focused to flows of gases charged in each in-piston passage in an upstroke of the piston, in which phase (I) is the state where both a mixture window and an air window are closed by a piston skirt portion; phase (II) is the state where the mixture window communicates with an in-piston passage; phase (III) is the state where the air window above the mixture window is coming into communication with the in-piston passage while the mixture window is in communication with the in-piston passage; phase (IV) is the state where both the mixture window and the air window above it communicate with the in-piston passage; and phase (V) is the state where the air window has come into communication with the in-piston passage while the mixture window keeps communication with the crankcase and permits the air-fuel mixture to flow into the crankcase.
Figure 4:
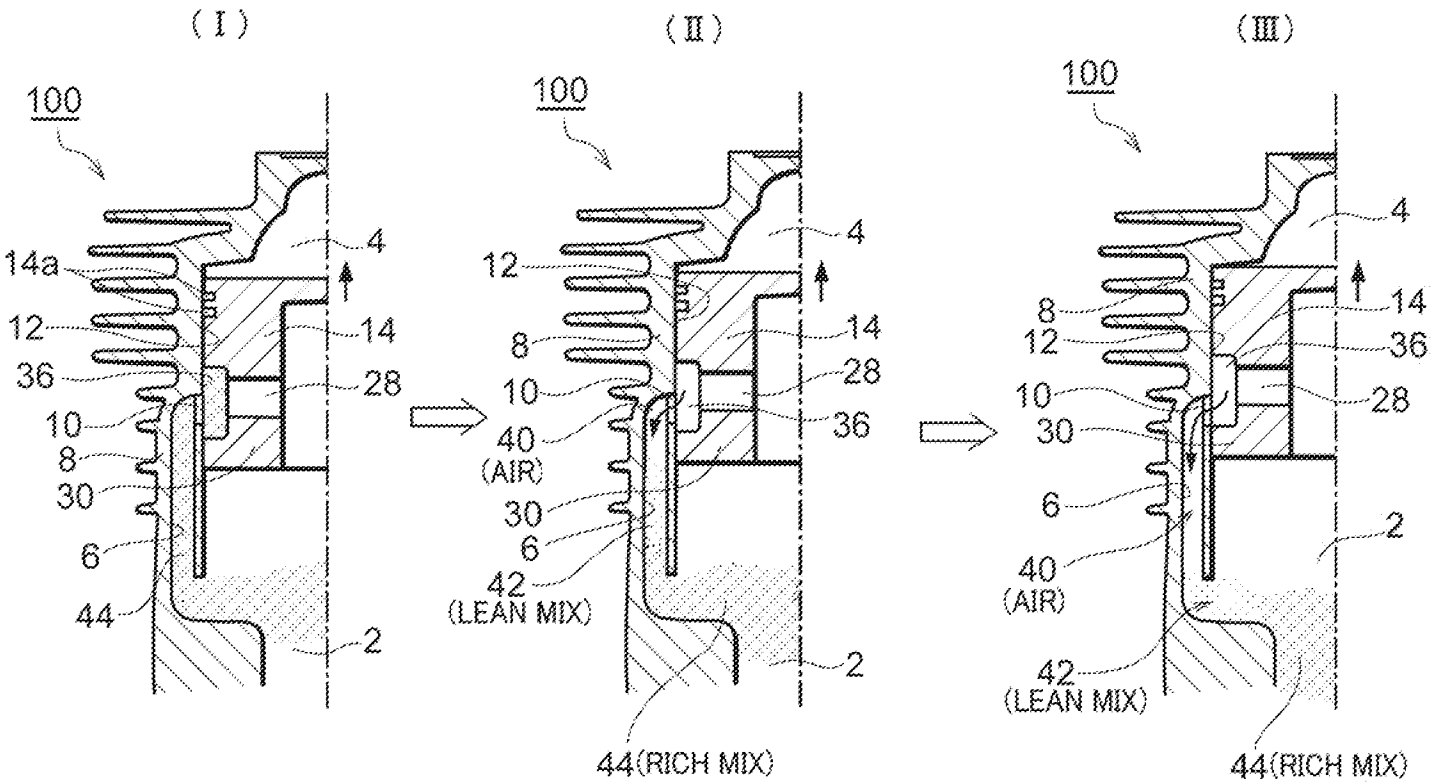
FIG. 4 illustrates transitional phases of the engine, focused to flows of gases that are charged in the scavenging passage through the in-piston passage when the in-piston passage is brought into communication with the scavenging passage in each upstroke of the piston, in which phase (I) is the state where rich air-fuel mixture generated by the carburetor is charged in the scavenging passage; phase (II) is the state where lean air-fuel mixture diluted with air in the in-piston passage is charged in the scavenging passage; and phase (III) is the state where air is charged in the scavenging passage.

As illustrated in FIG. 1 and FIG. 4, an air-cooled two-stroke internal combustion engine 100 according to an embodiment of the invention is a single-cylinder, compact-sized engine to be mounted in, for example, a hand-held work apparatus such as a chain saw or a brush cutter. Like conventional ones, this engine 100 includes scavenging passages 6 each communicating with both a crankcase 2 and a combustion chamber 4 (FIG. 4). The scavenging passages 6 are formed as an integral part of a cylinder block 8. The cylinder bore 12 has formed scavenging windows 10 each being an exit end of each scavenging passage 6. The scavenging windows 10 are opened and closed by reciprocal movements of the piston 14.

Like conventional ones, the engine 100 supplies air-fuel mixture (rich air-fuel mixture in the aforementioned context of this specification) into the crankcase 2, then compresses it with the piston 14, and supplies the compressed air-fuel mixture to the combustion chamber 4 via the scavenging passages 6. Although the engine 100 has two, one pair of, scavenging passages 6, the drawings show only one for simplicity. These scavenging passages 6 have substantially the same configuration.

In FIG. 1, reference numeral 16 indicates an ignition plug. The cylinder block 8 of the engine 100 has two ports 18 and 20 at a position circumferentially intermediate between the pair of scavenging passages 6, and these two ports 18 and 20 are aligned vertically, placing a partition 22 therebetween. These two ports 18 and 20 are coupled to a carburetor via a flexible coupling tube, not shown. Through this coupling tube, the upper port 18 is supplied with air, and the lower port 20 is supplied with rich air-fuel mixture of a predetermined air-fuel ratio as generated by the carburetor. The coupling tube includes two passages inside. One of the passages is used for transporting air and communicates with the air port 18. The other of the two passages is used for transporting the air-fuel mixture and communicates with the mixture port 20.

The air port 18 opens to the cylinder bore 12 at the air window 24. On the other hand, the mixture port 20 opens to the cylinder bore 12 at the mixture window 26. The air window 24 and the mixture window 26 are opened and closed by strokes of the piston 14.

Figure 2:
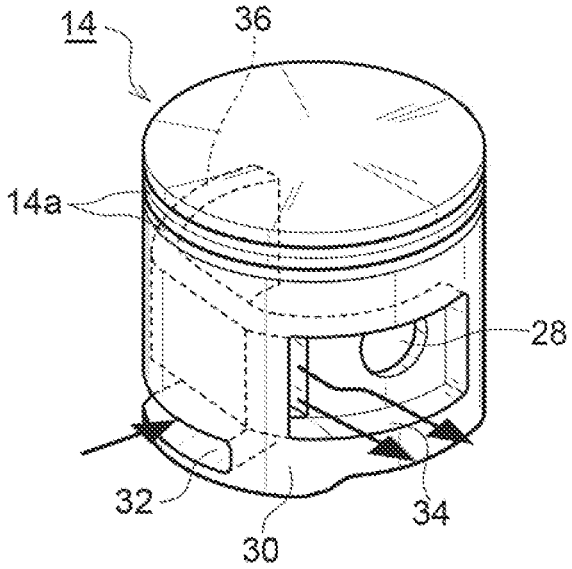
FIG. 2 is a perspective view of the piston.

FIG. 2 is a perspective view of the piston 14. As illustrated in FIG. 2, a plurality of annular piston ring grooves **14*a* are formed at an the upper end portion of the outer circumferential surface of the piston 14 to receive piston rings are fitted (not shown) therein as in conventional engines. At a lengthwise intermediate position of the piston 14, a piston pin hole 28 is formed to receive a piston pin (not shown), which connects the piston 14 to a small end of a connecting rod (not shown). The piston pin hole 28** extends, penetrating the piston in the radial direction.

Figure 3:
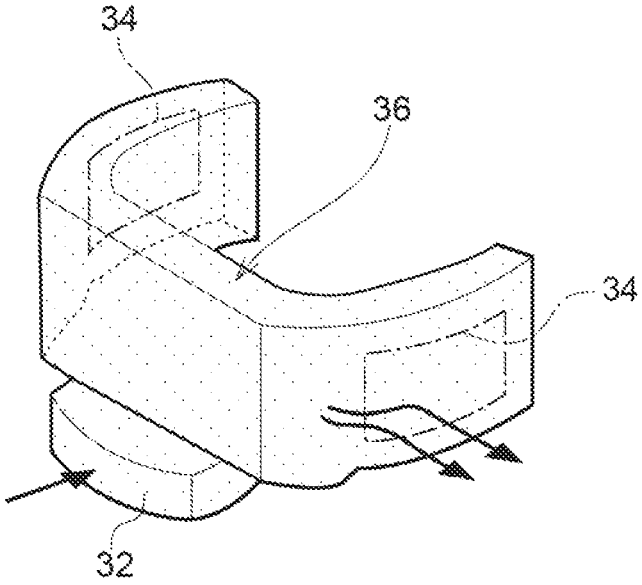
FIG. 3 illustrates the in-piston passage formed inside the piston.

The piston 14 has formed a first aperture 32 and two second apertures 34 at its skirt part 30. The second apertures 34, 34 are formed respectively at locations corresponding to two opposite ends of the piston pin hole 28. On the other hand, the first aperture 32 is formed at a location intersecting with the piston pin hole 28 at the lower end of the skirt part 30. The first aperture 32 and the second apertures 34 communicate with one another via an in-piston passage 36 formed inside the piston 14. FIG. 3 illustrates the configuration of the in-piston passage 36.

FIG. 1 and FIG. 4 show no exhaust port, but the cylinder block 8 has formed an exhaust port as conventional ones, and this exhaust port communicates with the cylinder bore 12 through an exhaust window. The exhaust window is opened and closed by reciprocal strokes of the piston 14 as in conventional engines.

Figure 6:
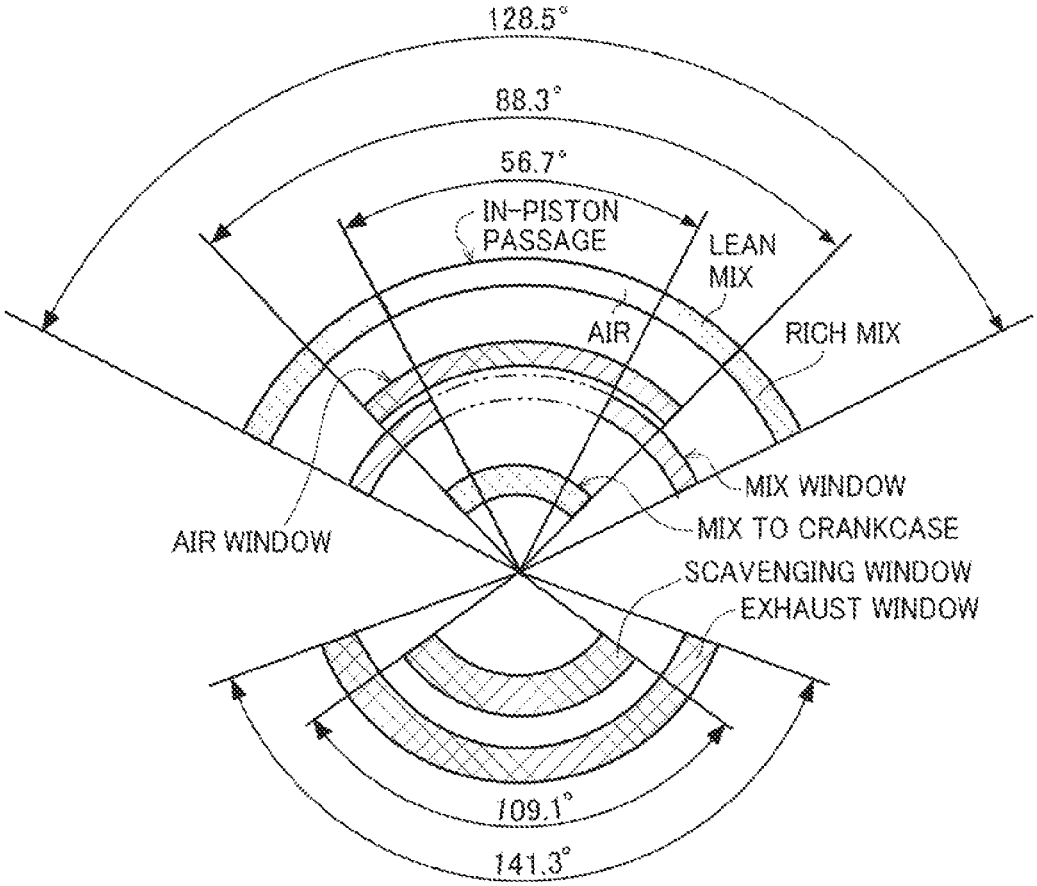
FIG. 6 illustrates timings for opening respective windows of the engine according to the present embodiment.

FIG. 6 is a diagram for explaining timings for charging gases in each scavenging passage 6 through the in-piston passage 36 in relation to specific crank angles. The angles appearing in FIG. 6 indicate these crank angles.

In the process of a downstroke of the piston 14 toward the bottom dead center and an upstroke from the bottom dead center, the exhaust window is opened, and burned gas within the combustion chamber 4 is discharged to the outside through the exhaust port. The angular range in which the exhaust window is opened is 141.3 degrees (see Exhaust Window in FIG. 6). Scavenging, i.e., opening of the scavenging windows 10 of the scavenging passages 6, takes place in the angular range of 109.1 degrees (see Scavenging Window in FIG. 6) within the said angular range of 141.3 degrees for exhaustion.

Still referring to FIG. 6, the mixture window 26 of the mixture port 20 is opened in the angular range of 128.5 degrees (see "Mix Window" in FIG. 6) and allowed to communicate with the in-piston passage 36. The in-piston passage 36 communicates with the scavenging passage 6 as well in this angular range of 128.5 degrees. Then, the mixture window 26 is closed in the angular range of 56.7 degrees (see the part shown by chain double-dashed lines in the arc of "Mix Window" in FIG. 6) within this range of 128.5 degrees. On the other hand, the air window 24 of the air port 18 is opened in the angular range of 88.3 degrees (see "Air Window" in FIG. 6) and allowed to communicate with the in-piston passage 36. The mixture port 20 opens into the crankcase 2 in the same angular range of 88.3 degrees (see "Mix to Crankcase" in FIG. 6).

As understood from the above explanation, the engine is configured such that the scavenging passages 6 are charged with rich air-fuel mixture through the in-piston passage 36 before the air-fuel mixture enters into the crankcase 2 from the mixture port 20. Therefore, by the use of negative pressure in the crankcase 2, the air-fuel mixture can be readily drawn into the scavenging passages 6 through the in-piston passage 36. In greater detail, in an initial period of each upstroke of the piston 14 in which the mixture port 20 does not yet communicate with the crankcase 2, a negative pressure is produced and increased in the crankcase 2, and this negative pressure acts to reduce the pressure in the scavenging passages 6 as well. Therefore, rich air-fuel mixture readily flows into the scavenging passages 6 through the in-piston passage 36. Even after the mixture port 20 starts opening to the crankcase 2, the pressure in the crankcase 2 and the pressure in the scavenging passages 6 still remain negative for a while, and in this period, the remainder of gases (air-furl mixture and air) to be charged in the scavenging passages 6 is readily drawn into these passages 6 through the in-piston passage 36.

These processes are explained again, more closely referring to FIG. 1. The air-fuel mixture alone is first supplied through the mixture window 26 into the in-piston passage 36 by using the negative pressure in the crankcase 2 in each upstroke of the piston 14 (phase (II) of FIG. 1). Next supplied are both the air-fuel mixture from the mixture window 26 and the air from the air window 24 (phase (III) and phase (IV) of FIG. 1). Then, the air alone is supplied from the air window 24 (phase (V) of FIG. 1). In the period of phase (III) and phase (IV) of FIG. 1, since the air-fuel mixture and the air are supplied concurrently into the in-piston passage 36, the air-fuel mixture is mixed with the air in the in-piston passage 36. Therefore, in phase (III) and phase (IV) of FIG. 1, the air-fuel mixture heretofore having the predetermined air-fuel ratio as generated by the carburetor is diluted in the in-piston passage 36 and changed to lean air-fuel mixture containing a relatively small amount of fuel component.

Therefore, the air-fuel mixture of the predetermined air-fuel ratio generated by the carburetor is first charged into the scavenging passages 6 through the in-piston passage 36 in each upstroke of the piston 14 (phase (I) of FIG. 4). As already explained, this air-fuel mixture is called herein "rich air-fuel mixture" (see "Rich Mix" in phase (II) and phase (III) of FIG. 4) because it is richer in fuel component than the lean air-fuel mixture. In the next stage, air-fuel mixture prepared by diluting rich air-fuel mixture with air in the in-piston passage 36 is charged (phase (II) of FIG. 4). This air-fuel mixture is herein referred to as "lean mixture" (see "Lean Mix" in phase (II) and phase (III) of FIG. 4) as well. In the next final stage, air is supplied (phase (III) of FIG. 4). In FIG. 4, reference numeral 40 indicates the air in the scavenging passage 6, reference numeral 42 indicates the lean air-fuel mixture, and reference numeral 44 indicates the rich air-fuel mixture.

Figure 5:
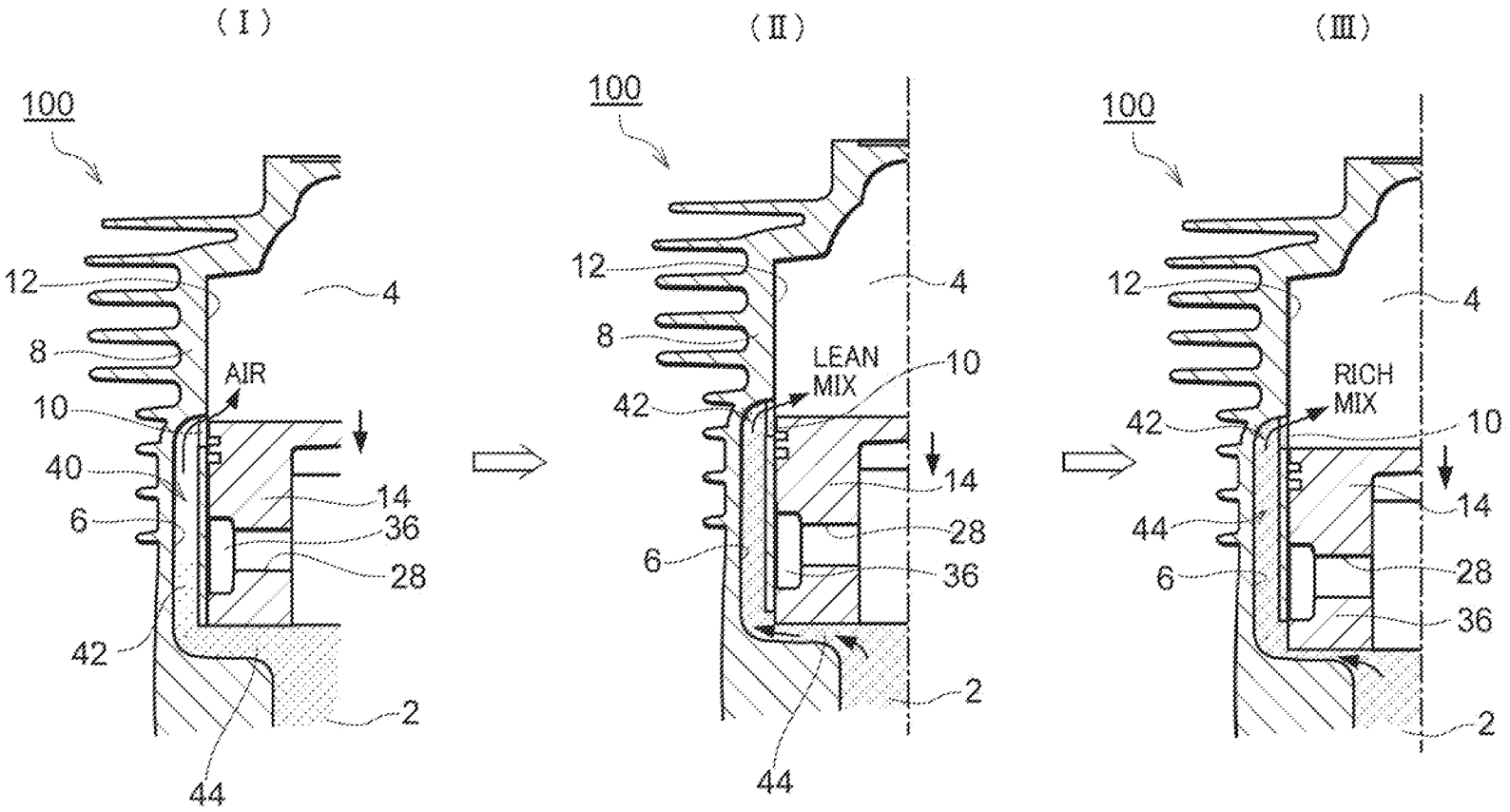
FIG. 5 illustrates different phases of the engine in each scavenging stroke, in which phase (I) is the state where heading air is supplied to the combustion chamber; phase (II) is the state where lean air-fuel mixture is supplied to the combustion chamber next to the heading air; and phase (III) is the state where rich air-fuel mixture generated by the carburetor is supplied to the combustion chamber next to the lean air-fuel mixture.

FIG. 5 shows the statuses in which the piston 14 has moved to levels opening the scavenging window 10 of the scavenging passage 6 gradually wider to the combustion chamber 4 in each downstroke of the piston 14 toward the bottom dead center. After that process, in the scavenging passage 6 charged with the gases through the in-piston passage 36 as shown at phase (III) of FIG. 4 or phase (I) of FIG. 5, the air 40 occupies the space of the scavenging passage 6 from its exit, i.e. the scavenging window, up to near the inlet (opening to the crankcase 2), and the lean air-fuel mixture 42 occupies the space around the inlet of the scavenging passage 6.

With reference to FIG. 5 again, when the scavenging window 10 starts opening in the downstroke of the piston 14, the air 40 within the scavenging passage 6 is supplied into the combustion chamber 4, and this air 40 is used for scavenging (phase (I) of FIG. 5). After the air 40 is supplied, the lean air-fuel mixture 42 is supplied into the combustion chamber 4 (phase (II) of FIG. 5). Following to the supply of the lean air-fuel mixture 42 in the scavenging passage 6, the rich air-fuel mixture 44 is supplied from the crankcase 2 as in conventional like systems. That is, the air-fuel mixture of the predetermined air-fuel ratio as generated by the carburetor is supplied into the combustion chamber 4 (phase (III) of FIG. 5).

Therefore, in the scavenging stroke, the heading air 40 flowing out of the scavenging passage 6 into the combustion chamber 4 is used for scavenging. Even though some blow-by of air-fuel mixture occurs, this method can reduce the outflow amount of the fuel component due to the blow-by. This is because it is the lean air-fuel mixture that is supplied into the combustion chamber 4 following to the heading air, and the lean air-fuel mixture that possibly flows out of the combustion chamber 4 contains only a small amount of fuel component.

In addition, when the scavenging passage 6 is charged with gases, they are supplied in the order of the rich air-fuel mixture, the lean air-fuel mixture and the air. Therefore, it is the air-fuel mixture that collides and may mix with the air-fuel mixture existing in the crankcase 2. Additionally, the lean air-fuel mixture exists as a buffer behind the rich air-fuel mixture and in front of the air. Therefore, this method significantly reduces the possibility that the air mixes with the fuel component in the process of charging the gases in the scavenging passage 6. Accordingly, even when the quantity of the air charged in the scavenging passage 6 is the same as the quantity of air charged for the same purpose in an engine of a conventional air-headed scavenging system, the method of the present invention can use a more amount of air for the intended purpose of scavenging.

Furthermore, even upon sudden acceleration of the engine from its idling state, there is no chance for air in the scavenging passage 6 to enter into the crankcase 2. Therefore, this method can significantly reduce fluctuations in air-fuel ratio of the air-fuel mixture in the crankcase 2, which may otherwise occur due to intrusion of air for scavenging. In addition, since it is the lean air-fuel mixture, instead of air, that may remain in the combustion chamber 4 after scavenging, the engine is improved in response to sudden acceleration.

Figure 7:
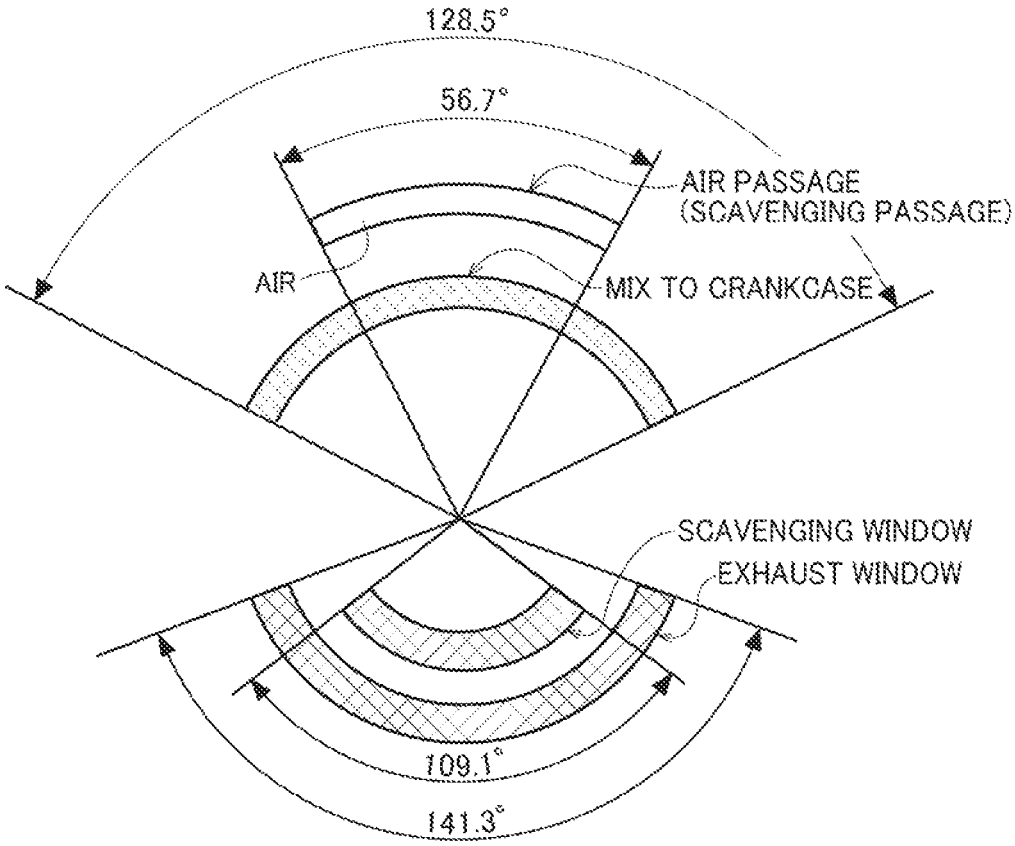
FIG. 7 illustrates timings for opening windows in a conventional engine in comparison with the timings shown in FIG. 6.

FIG. 7 is a diagram showing timings of charging gases in a conventional two-stroke internal combustion engine of an air-headed scavenging type. The mixture port 20 communicating with the crankcase 2 is opened in the angular range of 128.5 degrees in this conventional engine. As compared with FIG. 7, the embodiment of the present invention already explained with reference to FIG. 6 has apparently unique features significantly different from the conventional ones. More specifically, in FIG. 6 of the present invention, the mixture port 20 is opened to the crankcase 2 in the much smaller angular range of 88.3 degrees. Only in this angular range, the lean Mix (which is a result of concurrent introduction of the air-fuel mixture and the air into the in-piston passage 36) and the air are allowed to flow into the in-piston passage 36. The in-piston passage 36, as well, communicates only in this angular range.

As such, according to the timings of charging gases in the scavenging passages 6 charging of rich mixture first occurs prior to the timing of charging the crankcase 2 with rich mixture, and then follow the charging of lean mixture and air in this order. Accordingly, it is possible to control the amount of air drawn into the scavenging passage 6 more reliably.

As explained with this embodiment, the timing for the air to enter into the in-piston passage 36 is synchronous with the timing for air-fuel mixture to enter into the crankcase 2 directly from the mixture port 20. Therefore, it is possible to alleviate unexpected fluctuations of the negative pressure in the crankcase 2, which acts to draw the air into the scavenging passage 6 through the in-piston passage 36, and to thereby reduce instability of flow rate and timing for the air that enters into the scavenging passage 6.

In addition, the crankcase 2 is first charged with the air-fuel mixture through the in-piston passage 36 and the scavenging passage 6, and immediately thereafter without interruption, the crankcase 2 is charged with the air-fuel mixture directly from the mixture port 20, not via the scavenging passage 6. In other words, this method executes, consecutively without interruption, the process of charging the crankcase 2 with the air-fuel mixture through the in-piston passage 36 and the scavenging passage 6, and the process for charging the crankcase 2 with the air-fuel mixture directly from the mixture port 20. Therefore, fluctuations of the air-fuel ratio in the crankcase 2, if any, can be reduced in this serial charging of the air-fuel mixture into the crankcase 2.

The present invention is applicable to small-sized two-stroke internal combustion engines for use in work apparatuses such as chain saws and brush cutters.

What is claimed is:

1. A scavenging method for use with a two-stroke internal combustion engine having a scavenging passage in communication with a crankcase and a combustion chamber, comprising:

introducing air into the combustion chamber in a first portion of a scavenging stroke;

introducing lean air-fuel mixture in an amount regulated at least by a crank angle in a second portion of the scavenging stroke, which is subsequent to said first portion; and introducing rich air-fuel mixture of a predetermined air-fuel ratio in a third portion of the scavenging stroke, which is subsequent to said second portion, wherein the scavenging passage is sequentially supplied with air, lean air-fuel mixture and rich air-fuel mixture in this order through an end portion of an exit end thereof from a carburetor by opening and closing of an air port and a mixture port with a stroke of a piston regulated by crank angles, said lean air-fuel mixture being prepared by concurrently opening the air port and a mixture port and diluting air-fuel mixture supplied through the mixture port with air concurrently supplied through the air port, and wherein, in each scavenging stroke, the combustion chamber is supplied, from the exit end of the scavenging passage, first with said air, next with said lean air-fuel mixture, and next with said rich air-fuel mixture.

2. The scavenging method according to claim 1, wherein a timing for starting charging of the rich air-fuel mixture into the crankcase is synchronous with a timing for starting charging of the lean air-fuel mixture into the scavenging passage.

3. A two-stroke internal combustion engine having a cylinder bore in which a piston is fitted to define a combustion chamber in the cylinder bore, and a scavenging passage opening into the cylinder bore to communicate with a combustion chamber and a crankcase, said scavenging passage being opened and closed by strokes of the piston, so as to introduce air-fuel mixture generated by a carburetor into the crankcase and to supply the air-fuel mixture from the crankcase to the combustion chamber through the scavenging passage while compressing the air-fuel mixture with the piston, comprising:

a mixture port formed in said cylinder block to receive a supply of rich air-fuel mixture generated by the carburetor;

a mixture window formed in an outer wall of the cylinder bore as an opening of said mixture port to the cylinder bore, said mixture window being opened and closed by strokes of the piston;

an air port formed in the outer wall of the cylinder bore at a location above the mixture port and separated from the mixture port by a partition wall to receive a supply of air; and an air window formed in the outer wall of the cylinder bore as an opening of said air port to the cylinder bore, said air window being opened and closed by strokes of the piston, wherein the air and lean air-fuel mixture are stored in the scavenging passage in this order from an opening thereof to the combustion chamber toward the crankcase, and the air and the lean air-fuel mixture are introduced into the combustion chamber in this order from the scavenging passage to scavenge the combustion chamber, and said lean air-fuel mixture being prepared by concurrently opening the air port and the mixture port and diluting air-fuel mixture supplied through the mixture port with air concurrently supplied through the air port.

4. The two-stroke internal combustion engine according to claim 3, further comprising:

a piston gas passage formed in the piston to make communication of said mixture port and/or said air port with the scavenging passage via said mixture window and/or said air window, wherein, in each upstroke of the piston, the scavenging passage is capable of being first charged with the rich air-fuel mixture from the mixture port through the mixture window when the mixture port is in communication with the piston gas passage; the scavenging passage is capable of being next charged with lean air-fuel mixture, which is made as a mixture of the air-fuel mixture introduced from the mixture port through the mixture window with the air introduced from the air port through the air window when both the mixture window and the air window are simultaneously in communication with the piston gas passage; and the scavenging passage is capable of being next charged with the air from the air port through the air window when the air window is in communication with the piston gas passage, and wherein, in a scavenging stroke, the combustion chamber is capable of being supplied with the air, the lean air-fuel mixture, and the air-fuel mixture generated by the carburetor, in this order, through the scavenging passage.

5. The two-stroke internal combustion engine according to claim 4, wherein the piston gas passage is an in-piston passage formed inside the piston.

* * * * *